United States Patent [19]

Seidner

[11] 4,402,170

[45] Sep. 6, 1983

[54] MILLWORK MEMBER OF FOLDED CONSTRUCTION

[76] Inventor: Marc A. Seidner, 234 Conway Ave., Los Angeles, Calif. 90024

[21] Appl. No.: 235,838

[22] Filed: Feb. 19, 1981

[51] Int. Cl.[3] ..... E04C 2/00; E06B 1/04

[52] U.S. Cl. ..... 52/631; 52/71; 52/731

[58] Field of Search ..... 52/631, 731, 70, 71

[56] References Cited

U.S. PATENT DOCUMENTS

| | | | |
|---|---|---|---|
| 1,133,106 | 3/1915 | Cuppett | 52/631 X |
| 2,557,412 | 6/1951 | Clements | 52/631 X |
| 3,363,387 | 1/1968 | Schwindt | 52/631 X |
| 3,654,053 | 4/1972 | Toedter | 52/631 X |
| 3,729,870 | 5/1973 | Kvalheim et al. | 52/631 X |
| 3,911,554 | 10/1975 | Ford | 52/631 X |
| 4,019,303 | 4/1977 | McAllister | 52/631 X |

FOREIGN PATENT DOCUMENTS

| | | | |
|---|---|---|---|
| 643525 | 4/1937 | Fed. Rep. of Germany | 52/631 |
| 2905027 | 8/1979 | Fed. Rep. of Germany | 52/631 |
| 142366 | 6/1980 | German Democratic Rep. | 52/631 |
| 260801 | 8/1949 | Switzerland | 52/631 |

*Primary Examiner*—J. Karl Bell

*Attorney, Agent, or Firm*—Fulwider, Patton, Rieber, Lee & Utecht

[57] ABSTRACT

A millwork building construction member of rabbeted construction such as a doorjamb which includes a core to which a thin bendable exterior skin is bonded. The core is a non-lumber wood material such as composition board that has been folded after V-shaped grooves have been cut and the skin has been affixed. The skin is thus wrapped around the folded core to form the exterior surface of the member, while a cavity is defined that extends longitudinally through the core. The cavity can be filled for added strength. The skin may be selected for its decorative or fire-retardant properties.

20 Claims, 4 Drawing Figures

MILLWORK MEMBER OF FOLDED CONSTRUCTION

FIELD OF THE INVENTION

This invention relates to millwork building construction members, and more particularly to an improved member of that type and to a method of fabricating such a member.

BACKGROUND OF THE INVENTION

The term millwork refers to formed building construction members that are often rabbeted. Doorjambs, trim pieces and window frame components are representative of millwork.

A doorjamb, for example, which is a structure for receiving a door when closed, typically consists of three members, two vertical "legs" and one horizontal "head" which connects the upper ends of the legs. These doorjamb members have been commonly fabricated from lumber by cutting a single piece to yield the desired rabbeted shape.

When fabricating doorjamb members and the like from lumber, problems result the non-uniformity of the material, e.g., the presence of irregularities such as mixed grains, wood texture variations, moisture content differences, splits and/or knots. Shaping the lumber to achieve the desired configuration can be costly and results in a significant waste of material. Moreover, the cost of lumber of suitable quality has increased substantially in recent years.

To improve the relatively low fire rating of lumber, which is a measure of its ability to withstand a specified temperature for a specified time period, conventional wooden doorjamb members are sometimes given a fire retardant coating or impregnation. Laminated film and paint print coatings or veneers are sometimes applied for decorative purposes. The application of a veneer can be done manually in longitudinal sections, but requires additional fabrication expense, and produces interfaces where delamination could occur later.

Other such members have been formed from aluminum, by an extrusion process, or from steel. However, metal doorjambs are generally more expensive. For aesthetic or decorative reasons and to prevent oxidation, they have been often painted or otherwise covered in a decorative manner, requiring an additional step and higher labor costs in their fabrication. Steel members are difficult to install requiring tools and skill that often are not readily available at the construction site.

A principal objective of the present invention is to provide doorjamb members and other millwork building construction members that are made of relatively inexpensive materials. A further objective is to retain the advantages of conventionally constructed members and providing new solutions to some problems associated with previously known members of this type. A still further objective is to provide an improved method for the fabrication of such members.

SUMMARY OF THE INVENTION

The present invention resides in an improved millwork member for use in construction that accomplishes the above objectives. It includes a non-lumber wood product core, preferably a composition board such as fiberboard, and a thin bendable exterior skin which may be vinyl or acrylic film, aluminum, paper, wood veneer, or another sheet material selected for its decorative or fire-retardant properties.

Internal structural features of the member will be apparent from a method of making the member, this method being another aspect of the invention. First, the skin is bonded to a major surface of a panel that is to form the core. V-shaped grooves are then formed on the side of the panel opposite the skin, thereby dividing the panel into successive parallel rectangular sections. It is best to score the skin slightly when making the grooves. According to a preferred embodiment of the invention in which a doorjamb member is formed, there are five such grooves defining six sections.

Next, the panel is folded, closing the grooves. The skin is thus wrapped around the core and forms the entire exterior surface of the member.

In the case of a rabbeted member that is generally L-shaped, it is preferable to notch one edge of the panel on the side thereof to which the skin is attached. When the panel is folded, this notch receives the opposite end of the panel. Glue can be applied to selected portions of the panel before folding to later hold the panel in its folded position.

If a heat-conducting skin, such as aluminum, is used, a saw cut can be made along one exterior surface of the member, if desired. This break in the skin forms a thermal barrier, and can retain weather stripping if desired.

Other features and advantages of the present invention will become apparent from the following detailed description, taken in conjunction with the accompanying drawings, which illustrate, by way of example, the principles of the invention.

DESCRIPTION OF THE PREFERRED EMBODIMENT

Figure 2:
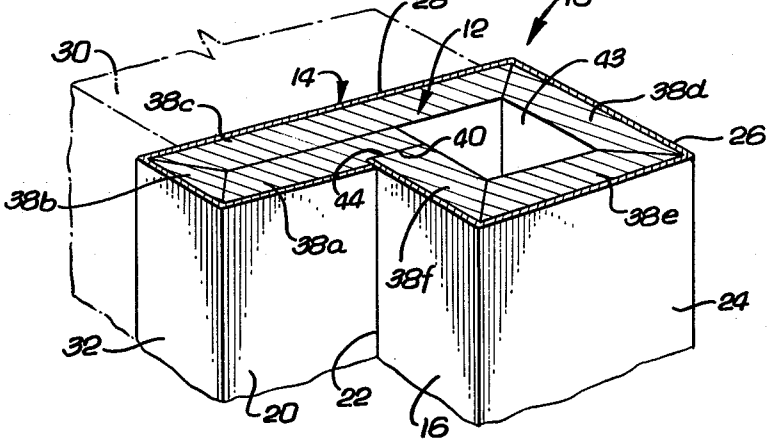
FIG. 2 is a cross-sectional perspective view of the doorjamb taken along line 2—2 in FIG. 1.
Figure 1:
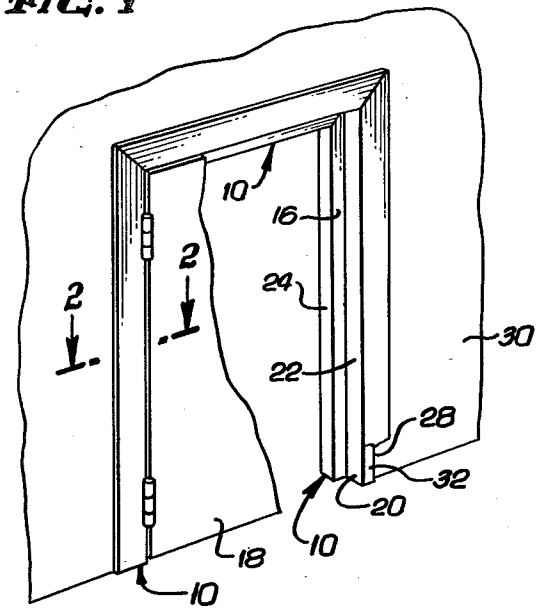
FIG. 1 is a perspective view of a doorway featuring a doorjamb constructed in accordance with the present invention, a fragmentary portion of a door mounted within the jamb being shown.
Figure 3:
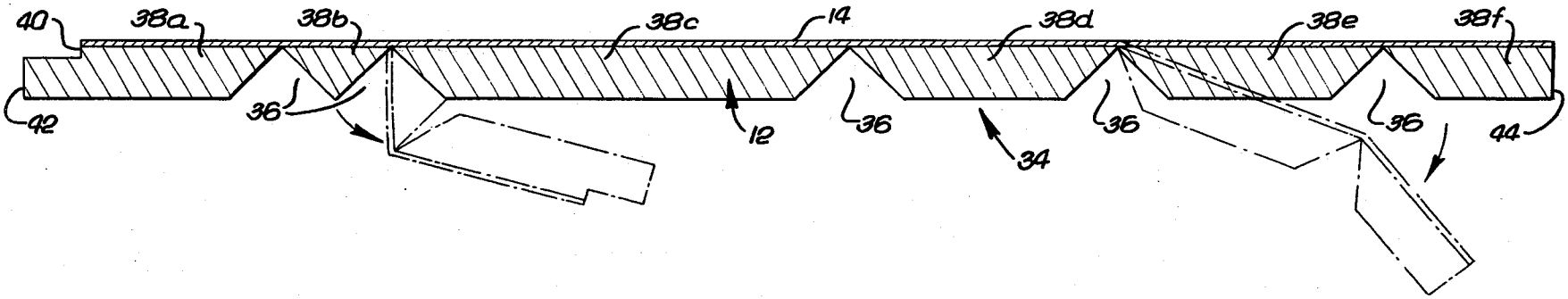
FIG. 3 is a cross-sectional view of the grooved composition board panel from which one member of the doorjamb member is assembled, phantom lines illustrating part of the procedure of folding the panel to yield the assembled doorjamb member.

A rabbeted doorjamb member 10, shown in FIGS. 1–3 and embodying the present invention, includes a composition board core 12 and a thin exterior skin 14. Three such members 10 can be combined to form the legs and head of one doorjamb, as shown in FIG. 1.

Each member 10 is of a generally L-shaped configuration in cross-section, as best shown in FIG. 2. It has a first door receiving surface 16, parallel to the plane of a door 18 and perpendicular to a second door receiving surface 20. The door receiving surfaces 16 and 20 meet to form an inside corner 22 in which an edge of a door 18 is positioned when closed in the conventional manner.

An entrance surface 24 is perpendicular and adjacent to the first door receiving surface 16, and a back surface 26 extends perpendicular to the entrance surface and parallel to the first door receiving surface. Perpendicular to the back surface 26 in an attachment surface 28 that permits securement of the member 10 to an abutting wall 30. A front surface 32 connects the attachment surface 28 to the second door receiving surface 20, being perpendicular to both.

The internal structural features of the member 10 are best understood from the following description of a method of making the member. First, the exterior skin 14 is bonded to a major surface of the core 12 while the core is in the form of a flat rectangular panel 34. The panel 34 is of a non-lumber wood-product, meaning that although made of wood it is manmade or fabricated industrially and is not simply cut from logs. The preferred material is composition board, which includes particle board, wafer board, oriented strand board and hard board. Fiberboard is a particularly advantageous form of hard board. Exterior plywood is another suitable non-lumber product. The panel material should have a density of not less than 44 pounds per cubic foot. The skin 14 can be chosen for its decorative qualities and may be vinyl, acrylic, paper, a resin impregnated paper such as melamine, aluminum, brass or a wood veneer. A non-wood skin may be imprinted or embossed with a wood grain pattern. A wood veneer should have a depth of at least 0.010 to 0.012. Aluminum skin does not require a depth of more than 0.012. In the case of a composition board panel 34, the skin 14 is applied to a surface that lies perpendicular to the direction in which the panel was pressed when formed.

Five V-shaped grooves 36 are formed in the panel 34 (as shown in FIG. 3) dividing the panel into six elongated, parallel, rectangular sections 38*a, b, c, d, e* and *f*. Each groove 36 faces away from the skin 14, the sides of the groove forming ninety-degree angles with each other and forty-five-degree angles with the panel surfaces when the panel 34 is laid flat. The depth of the grooves 36 is such that they extend substantially all the way through the panel 34 to the skin 14. Preferably, the grooves are deep enough to score the skin. For example, a skin of 0.012 inches should be scored to a depth of 0.002 to 0.003 inches.

A notch 40 of rectangular cross-section is formed along one edge 42 of the panel 34 on the side to which the skin 14 is bonded. The grooves 36 and the notch 40 can be formed by a molder cutter head or other cutting tool, as known to those skilled in the art. Glue is applied in the grooves 36 and the notch 40 and on surfaces that are to be mated.

The panel 34 is then folded so that the grooves 36 become closed incisions where adjacent sections 38 are disposed at right angles to each other, as shown in FIG. 2. The notch 40 receives the opposite edge 44 of the panel 34, with the first and third sections 38*a* and *c*, which define the second door receiving surface 20 and the attachment surface 28, being pressed against each other. A remaining part of the third section 38*c*, together with the fourth, fifth and sixth sections 38*d, e,* and *f* define an internal cavity 43 of rectangular cross section that extends throughout the length of the member 10. If desired, a staple or tack can be driven through the third section 38*c* into the opposing edge 44 of the panel 34 to hold the panel in its folded position while the glue dries.

Once the member 10 is assembled, the one-piece skin 14 has been wrapped completely around it, forming all exterior surfaces. Since the skin 14 is bonded to the panel 34, it is bent when the panel 34 is folded and need not be handled separately.

Figure 4:
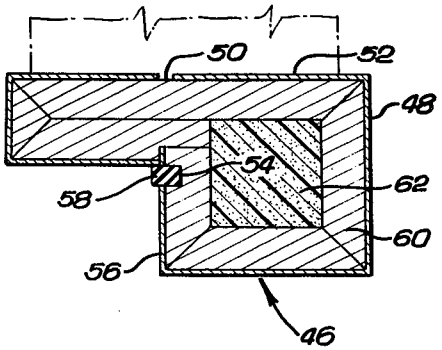
FIG. 4 is a cross-sectional view of another doorjamb also constructed in accordance with the invention.

In a second embodiment of the invention, shown in FIG. 4, a doorjamb member 46 is formed which is generally similar to number 10 described above. In this case, however, the skin 48 is aluminum which is a good thermal conductor. To provide a thermal barrier, preventing heat loss from one side of the door to the other, the skin 48 is interrupted by a first shallow groove 50 cut along the attachment surface 52 and a second groove 54 cut along the first door receiving surface 56. The second groove 54 provides the dual function of receiving a conventional weather strip 58.

The cavity formed by the core 60 of the member 46 is filled with a plastic foam 62 for added strength and rigidity. Alternatively, an extruded plastic insert or an insert of any other suitable material can be used.

It will be appreciated from the foregoing that the present invention enables a high quality doorjamb to be constructed of composition board and other inexpensive materials. Waste of materials is minimized and the assembly process is unusually simple and economical.

There are other important advantages that are not so easily apparent. First, it should be noted that many desirable core materials such as particle board present serious screw retention problems. Such materials do, however, have satisfactory screw retention properties if the screw is driven in a direction perpendicular to the core panel 12, i.e., in the direction in which the panel was pressed when formed. According to this invention, a screw driven perpendicular to any exposed major surface of the member 10 or 46 covered by the skin 14 or 48 enters the panel in a direction in which it will be retained satisfactorily.

It should also be noted that the non-lumber materials that are used for the core are of uniform consistency. This eliminates the differential expansion and contraction and attendant warps that might occur if the various sections of the core were made of lumber.

While particular forms of the invention have been illustrated and described, it will be apparent that various modifications can be made without departing from the spirit and scope of the invention.

I claim:

1. A rabbetted one-piece door jamb comprising:

a composition board core that is cut to form first, second, third, fourth, fifth and sixth successive sections assembled in a generally L-shaped configuration and defining a rectangular cavity extending therethrough, said first section being notched longitudinally to engage an end of said sixth section which extends in a direction generally perpendicular to said first section, said first and third sections extending generally parallel to one another and abutting against one another for substantially the entire length of said first section; and an exterior skin bonded to each of said core sections and extending completely around said core to form the exterior surface thereof.

2. The door jamb of claim 1 including an interruption in said skin forming a thermal barrier.

3. An integrally formed, one-piece rabbeted doorjamb member having a first door receiving surface perpendicular to a door plane; a second door receiving surface parallel to said door plane and perpendicular to said first door receiving surface, said door receiving surfaces meeting to define an inside corner in which a closed door can be received; an entrance surface perpendicular and adjacent to said second door receiving surface; a back surface perpendicular and adjacent to said entrance surface; an attachment surface perpendicular and adjacent to said back surface to allow securement of said member to an abutting wall; a front surface perpendicular and adjacent to said attachment surface at one end, and perpendicular and adjacent to said first door receiving surface at the opposite end; said member comprising:

a composition board core having a plurality of longitudinal incisions extending the full length thereof, each of said incisions being shaped to define a V-shaped groove, the sides of which form a ninety-degree angle when said core is laid flat; and a bendable exterior skin bonded to said core on the side thereof opposite the direction faced by said grooves;

said core and said skin being folded along said grooves so as to close said grooves and define a rectangular cavity extending through said core, said skin covering said core over each of said above-mentioned surfaces.

4. A doorjamb member as recited in claim 3 wherein each of said grooves extends through said core into said skin, whereby said skin is scored.

5. A doorjamb member as recited in claim 4 wherein said skin is wood.

6. A doorjamb member as recited in claim 3 wherein said composition board is fiberboard.

7. A doorjamb member as recited in claim 3 wherein said skin is acrylic or vinyl.

8. A doorjamb member as recited in claim 3 wherein said skin is aluminum.

9. A doorjamb member as recited in claim 3 wherein said composition board is fiberboard and said skin is acrylic or vinyl.

10. A doorjamb member as recited in claim 3 wherein said composition board is fiberboard and said skin is a wood veneer.

11. A doorjamb member as recited in claim 10 wherein said cavity is filled with a plastic.

12. A door joint member as recited in claim 3 wherein there are five of said grooves and six of said sections.

13. A method of forming a rabbeted one-piece door jamb comprising the steps of:

bonding a thin bendable skin to a major surface of a rectangular panel;

cutting V-shaped grooves longitudinally along said panel in the surface thereof opposite said skin, said grooves extending substantially through said panel to said skin and thereby dividing said panel into a plurality of elongated, parallel, rectangular sections folding said panel and said skin so as to close said grooves and assemble said sections into a generally L-shaped core in which a door receiving section having a door receiving surface parallel to a plane of a door received by the door jamb abuts against a reinforcing secton for substantially the entire length of said door receiving section, said L-shaped core having a rectangular cavity extending therethrough, said skin being wrapped around said core as the exterior surface of the member thus formed; and securing said panel in said folded position.

14. The method of claim 13 wherein said step of securing said panel is performed by gluing said sections in place.

15. The method of claim 13 further comprising the step of forming a notch extending longitudinally along one edge of said panel on the side thereof to which said skin is bonded, an edge of one of said sections being received by said notch when said panel is folded.

16. The method of claim 13 further comprising the step of filling said cavity with plastic foam.

17. The method of claim 13 further comprising the step of cutting said skin to form a thermal barrier.

18. The method of claim 13 further comprising the steps of:

cutting a groove through said skin, thereby forming a thermal barrier; and inserting a weather strip in said groove.

19. The method of claim 13 wherein said grooves cut through said panel so as to score said skin.

20. A method of forming a rabbeted door jamb member comprising the steps of:

bonding a thin bendable vinyl skin to a major surface of a rectangular fiberboard panel;

forming five V-shaped grooves longitudinally along said panel in the surface thereof opposite said skin, said grooves extending through said panel and scoring said skin, thereby dividing said panel into first, second, third, fourth, fifth and sixth successive sections;

forming a notch extending longitudinally along an edge of said panel corresponding to a portion of said first section on a side thereof to which said skin is bonded;

cutting said skin to form a thermal barrier;

applying glue on at least one portion of said panel;

folding said panel and said skin so as to close said grooves and assemble said sections into a generally L-shaped core in which said first section extends generally perpendicular to said sixth section and engages an end of said sixth section within said notch and in which said first and third sections extend generally parallel to one another and abut against one another for substantially the entire length of said first section, said L-shaped core having a rectangular cavity extending therethrough, thereby wrapping said skin around said core as the exterior surface of member thus formed; and allowing said glue to set to secure said panel in said folded position.

* * * * *